US005665178A

United States Patent [19]

Komatsubara et al.

[11] Patent Number: 5,665,178

[45] Date of Patent: Sep. 9, 1997

[54] METHOD OF MANUFACTURING GRAIN-ORIENTED SILICON STEEL SHEET HAVING EXCELLENT MAGNETIC CHARACTERISTICS

[75] Inventors: Michiro Komatsubara; Masayoshi Ishida; Kunihiro Senda, all of Okayama, Japan

[73] Assignee: Kawasaki Steel Corporation, Japan

[21] Appl. No.: 596,996

[22] Filed: Feb. 5, 1996

[30] Foreign Application Priority Data

Feb. 13, 1995 [JP] Japan ..... 7-023997

[51] Int. Cl.[6] ..... H01F 1/14

[52] U.S. Cl. ..... 148/111

[58] Field of Search ..... 148/111, 113

[56] References Cited

U.S. PATENT DOCUMENTS 5,413,640 5/1995 Manabe et al. ..... 148/111

FOREIGN PATENT DOCUMENTS 0 378 131 A3 7/1990 European Pat. Off. .

0 390 140 A1 10/1990 European Pat. Off. .

0 566 986 A1 10/1993 European Pat. Off. .

4337029 11/1992 Japan .

5156361 6/1993 Japan .

6033141 2/1994 Japan .

*Primary Examiner*—John Sheehan

*Attorney, Agent, or Firm*—Austin R. Miller

[57] ABSTRACT

A method of manufacturing a grain-oriented silicon steel sheet having excellent and stable magnetic characteristics which includes the steps of subjecting a silicon steel slab to hot rolling to form a hot-rolled sheet, cold rolling the hot-rolled sheet at least once with intermediate annealings between successive cold rollings to form a cold-roiled sheet, and thereafter primary recrystallization annealing the cold-rolled sheet to form a primary recrystallized sheet. The primary recrystallized sheet is then final finish annealed, which includes a secondary recrystallization annealing and a purifying annealing during which the steel slab is coated with an annealing separator. The coercive force of the primary recrystallized steel sheet is controlled to a predetermined range before the start of secondary recrystallization.

3 Claims, 2 Drawing Sheets

METHOD OF MANUFACTURING GRAIN-ORIENTED SILICON STEEL SHEET HAVING EXCELLENT MAGNETIC CHARACTERISTICS

BACKGROUND OF THE INVENTION

1. Field of the Invention

The present invention relates to a method of manufaturing a grain-oriented silicon steel sheet having excellent magnetic characteristics and capable of being used as a core material for a transformer or the like.

2. Description of the Related Art

A grain-oriented silicon steel sheet usable as a core material for various types of transformers possesses crystal grains highly integrated in an orientation which has an easily magnetized axis (110) [001] in the rolling direction, i.e., in a so-called Goss-orientation. Flux density reflects the degree of orientation in a steel sheet and is generally evaluated by a value $B_8$(T), showing the flux density in a magnetic field of 800 A/m.

A phenomenon known as secondary recrystallization is utilized to align crystal grains in the Goss-orientation. Secondary recrystallization involves an abnormal grain growth behavior which has a very strong orientation selectivity, wherein ordinary crystal grains (which are called primary recrystallized grains) are thermally grown. It is very important to control orientation selectivity and abnormal grain growth when seeking excellent secondary recrystallized grains having a high degree of integration in the Goss-orientation. For this purpose, it is important to maintain a delicate balance between aggregate structure, crystal grain size, and the restraining force of an inhibitor (the ability of an inhibitor to restrain precipitates as a dispersed second phase and the movement of a grain boundary due to the segregation of a component in the grain boundary). Proper balancing restrains the growth of crystal grains and the like in primary recrystallization prior to secondary recrystallization.

Although aggregate structure, crystal grain size and inhibitor restraining force may be adjusted by controlling hot rolling, cold rolling and primary recrystallization annealing such adjustments require fine control of temperature rolling reduction, and surface state control, and create problems in industrial scale production.

Since defective stripe-shaped secondary recrystallized crystals often grow along the rolling direction, secondary recrystallized crystals defectively grow over the entire sheet surface and the crystal orientation of secondary recrystallized grains varies greatly from the Goss orientation. As a result, magnetic characteristics deteriorate and a large amount of scrap iron is generated. Further, such fine control of parameters affecting magnetic characteristics in industrial scale manufacturing processes is often difficult or impossible to achieve, thereby creating problems in yield and quality control.

Japanese Patent Application Laid-Open No. 2-267223 discloses a means for controlling the conditions of primary recrystallization annealing so that primary recrystallized grains are controlled within parameters. The method involves the monitoring of grain size of the primary recrystallized grains through an on-line system. Further, Japanese Patent Application Laid-Open No. 4-337029 discloses a means for controlling primary recrystallization annealing temperature so that the primary recrystallized grain size is within a range of 15–25 μm. The method involves measuring the N content of a steel sheet prior to final cold-rolling.

These prior art technologies focus on the conditions of primary recrystallization annealing (temperature and line speed) to stabilize and improve the magnetic characteristics of a product. The primary recrystallized grain size is controlled because it greatly affects the behavior of secondary recrystallized grains as described above. However, when the inhibitor restraining force is changed by variations in hot-rolling conditions and annealing conditions (including cooling conditions) after cold rolling, the optimal primary recrystallized grain size also changes in accordance with these variations. Therefore, magnetic characteristics cannot be stabilized even when defective growth of secondary recrystallized crystals can be restrained, thereby severely inhibiting the practical applicability of these technologies.

Other technologies for obtaining secondary recrystallized grains having excellent magnetic characteristics by controlling primary recrystallized grain size are known. For example, Japanese Patent Application Laid-Open No. 2-182866 discloses a means for controlling a grain size of crystals after primary recrystallization annealing to 15 μm or more with a coefficient of Variation of 0.6 or less. Japanese Patent Application Laid-Open No. 6-33141 discloses a means for controlling average grain size after primary recrystallization annealing to 6–11 μm with a coefficient of variation of 0.5 or less, which also involves increasing the average grain size 5–30% just before the start of secondary recrystallization. Japanese Patent Application Laid-Open No. 5-156361 discloses a means for controlling primary recrystallized grain size to 10–35 μm before the start of final finishing annealing after primary recrystallization annealing. Japanese Patent Application Laid-Open No. 5-295438 discloses a means for controlling primary recrystallized grain size to 18–35 μm.

Although these technologies seek to produce good secondary recrystallized crystals for improved magnetic characteristics by controlling primary recrystallized grain size, none has addressed the problem of unstable magnetic characteristics arising in industrial scale production.

The present invention advantageously addresses these problems by balancing primary recrystallized grain size with the inhibitor restraining force to control secondary recrystallized crystals for the improvement and stabilization of magnetic characteristics.

OBJECTS OF THE INVENTION

An object of the invention is to provide a method of manufacturing a grain-oriented silicon steel sheet having stable and excellent magnetic characteristics.

Other objects and advantages of the invention will become apparent from the description provided below. In the description which follows, specific terms will be used in the interest of clarity. These are not intended to define or to limit the scope of the invention which is defined in the appended claims.

SUMMARY OF THE INVENTION

Through various experiments and examinations, we have discovered for the first time that the coercive force of a primary recrystallized steel sheet before the start of secondary recrystallization can be controlled to effectively improve and stabilize the magnetic characteristics of a silicon steel sheet. Coercive force ills the magnetic field strength required to reduce magnetization of a ferromagnetic body in a saturated magnetic state to zero. Methods of measuring coercive force will be described hereinafter.

Specifically, we have discovered a method of manufacturing a grain-oriented silicon steel sheet having excellent and stable magnetic characteristics which includes the steps of subjecting a silicon steel slab to hot rolling to form a hot-rolled sheet, cold rolling the hot-rolled sheet at least once with intermediate annealings between successive cold rollings to form a cold-rolled sheet, and thereafter primary recrystallization annealing the cold-rolled sheet to form a primary recrystallized sheet. The primary recrystallized sheet is then final finish annealed, which includes a secondary recrystallization annealing and a purifying annealing during which the steel sheet is coated with an annealing separator. The coercive force of the primary recrystallized steel sheet is controlled to a predetermined range before the start of secondary recrystallization.

We have also discovered surprising effectiveness from the related steps of measuring the coercive force of the primary recrystallized sheet, and then adjusting the primary recrystallization annealing conditions accordingly, and adjusting the components of the annealing separator and/or the secondary recrystallization annealing conditions, if needed. The step of measuring the coercive force can be performed by use of an on-line system.

DETAILED DESCRIPTION OF THE INVENTION

An example of an experiment by which the invention was discovered will now be described. This example is not intended to define or to limit the scope of the invention, which is defined in the appended claims.

A multiplicity of slabs each containing C: 0.073 wt %, Si: 3.25 wt %, Mn: 0.072 wt %, sol Al: 0.025 wt %, S: 0.003 wt %, Se: 0.014 wt %, Sb: 0.025 wt % and N: 0.007 wt %, with the balance Fe and incidental impurities, were formed. These slabs, each of which was heated at a slab heating temperature of either 1380° C., 1395° C., 1410° C. or 1425° C., were hot rolled to hot-rolled coils having a thickness of 2.3 mm at rough-rolling outlet temperature range of 1100°–1280° C. and a finish-rolling outlet temperature range of 850°–1050° C. Thereafter, the hot-rolled coils were subjected to hot-rolled sheet annealing at a temperature range of 950°–1250° C., and to final cold rolling at a temperature range of 100°–280° C. with a strong rolling reduction of about 88%, thereby forming cold-rolled coils having a final thickness of 0.285 mm.

These cold-rolled coils were subjected to primary recrystallization annealing, which also served as a decarburization, by increasing the soaking temperature from 800° C. to 900° C. at intervals of 5° C. The primary recrystallized coils were then subjected to final finish annealing after being coated with an annealing separator mainly composed of MgO.

Flux density $B_8$(T), a secondary recrystallization ratio and a rotational angle (α) from a crystal orientation (110) [001] of the thusly obtained steel sheets were measured and plotted against the average primary recrystallized grain size and the coercive force. The results are summarized in FIGS. 1 and 2.

Figure 1:
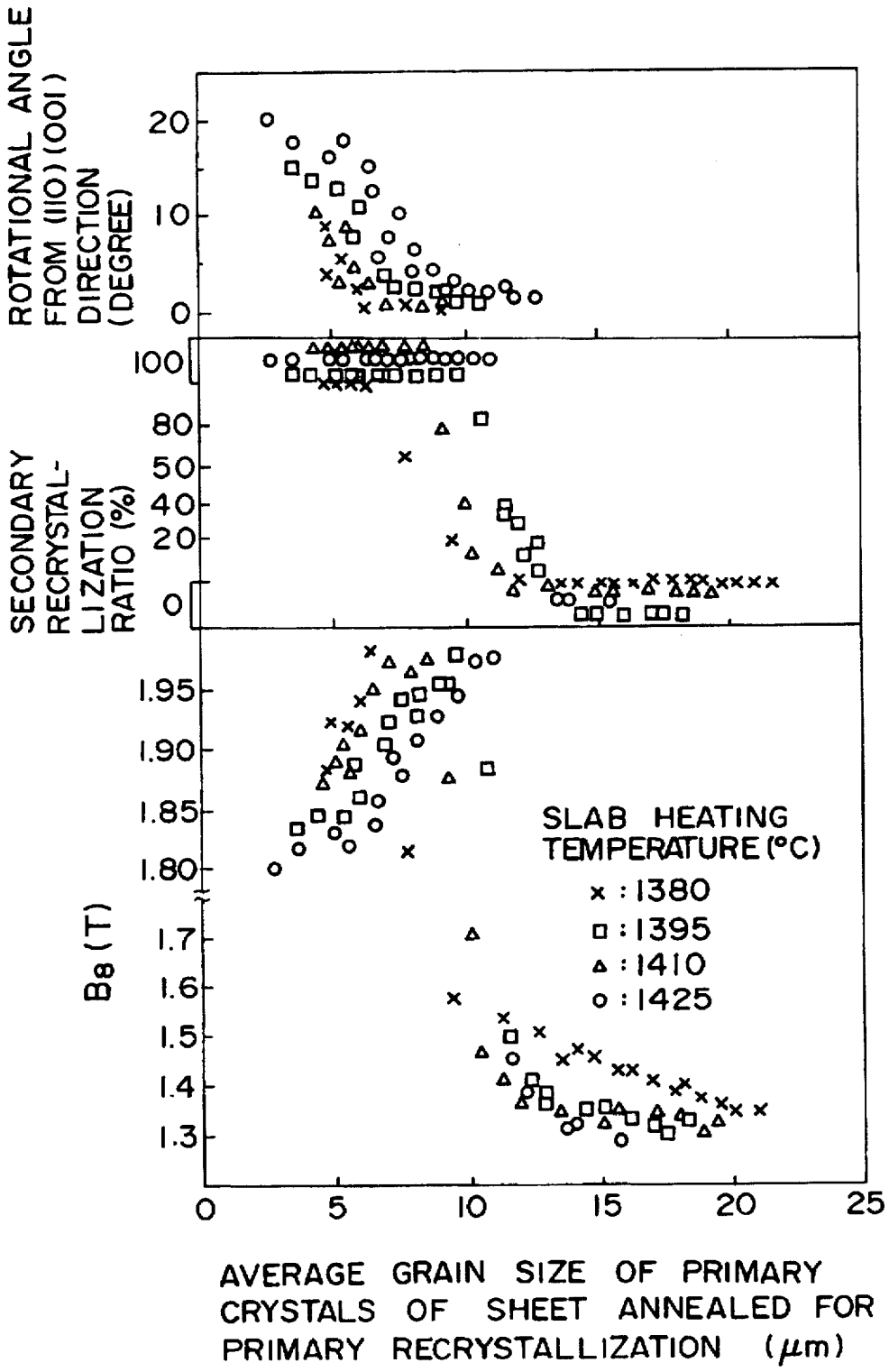
FIG. 1 is a graph showing relationships between average primary recrystallized grain size in a steel sheet and flux density, secondary recrystallization ratio and rotational angle from a crystal orientation (110) [001] of a steel sheet subjected to final finish annealing.

As is apparent from FIG. 1, when the slab heating temperature is changed, in other words, when the inhibitor restraining force is changed, different magnetic characteristics $B_8$(T) are obtained even if the average primary recrystallized grain size is the same, thereby demonstrating that the relationship between the average primary recrystallized grain size and the magnetic characteristics is greatly changed. Consequently, FIG. 1 reveals that merely controlling primary recrystallized grain size cannot ensure the formation of secondary recrystallized crystals which result in excellent magnetic characteristics.

Figure 2:
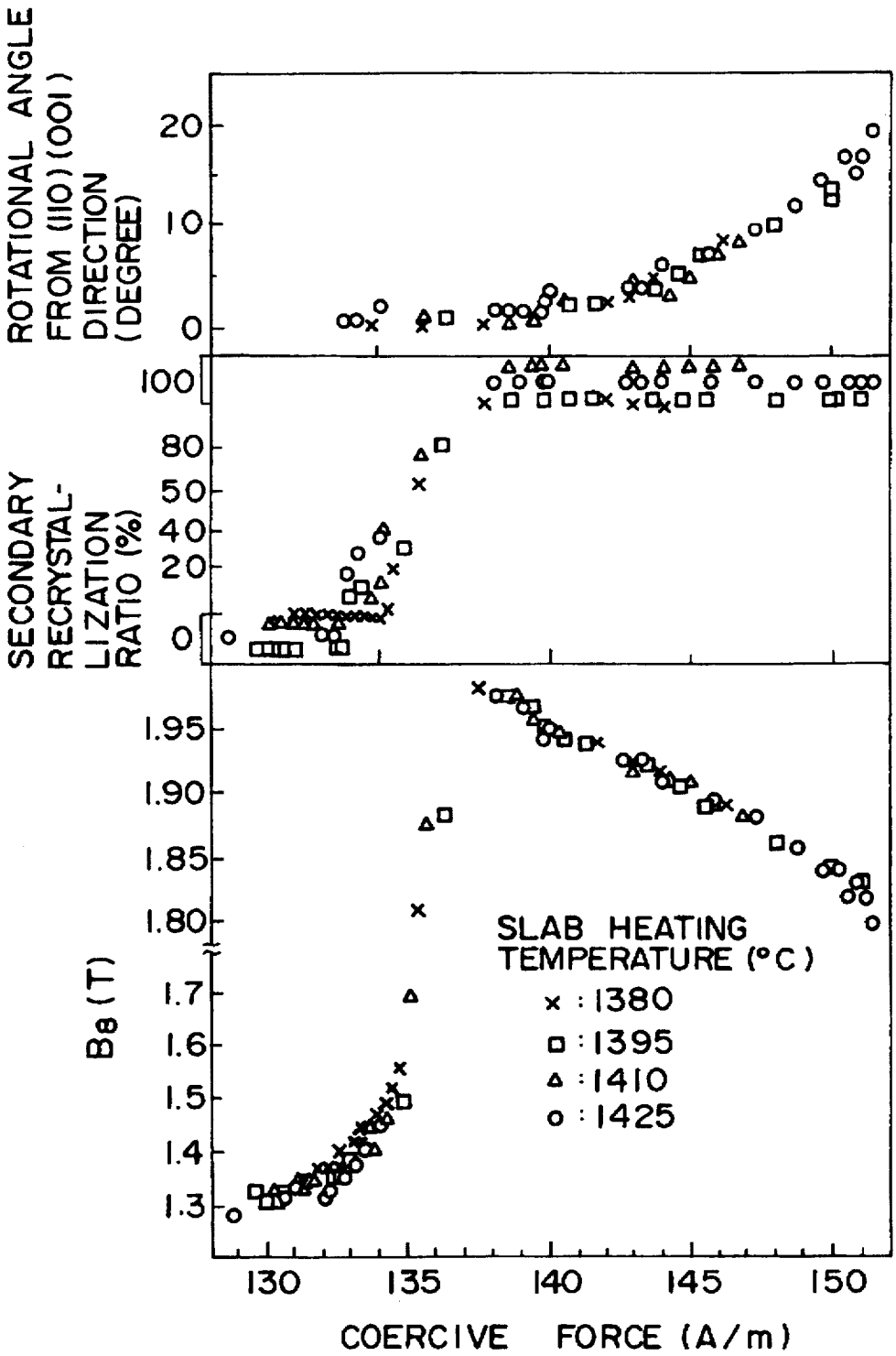
FIG. 2 is a graph showing relationships between coercive force of a steel sheet subjected to primary recrystallization annealing and flux density, secondary recrystallization ratio and rotational angle from a crystal orientation (110)[001] of a steel sheet subjected to final finish annealing.

On the other hand, as shown in FIG. 2, even if the slab heating temperature is changed, the relationship between the coercive force of the steel sheets subjected to primary recrystallization annealing and magnetic characteristics $B_8$(T) remains substantially unchanged. FIG. 2 reveals that these particular steel sheets have excellent magnetic characteristics in the coercive force range of 135–140. Therefore, FIG. 2 demonstrates that coercive force can be used as a control parameter to maximize the magnetic characteristics after the final finish annealing with very high reproducibility.

Coercive force is a phenomenon that reflects not only primary recrystallized grain size, but also the dispersed second phase precipitated into steel. It is very difficult to predict accurately magnetic characteristics of a steel sheet subjected to final finish annealing by just monitoring primary recrystallized grain size. The magnetic characteristics of a steel sheet subjected to primary recrystallization annealing are also influenced by changes in the precipitated state of an inhibitor (dispersed second phase) caused by a change of slab heating temperature. However, the magnetic characteristics of a steel sheet subjected to final finish annealing can be accurately predicted by observing the coercive force of a steel sheet subjected to primary recrystallization annealing because the coercive force reflects both primary recrystallized grain size and the precipitated state Of the inhibitor, both of which have been found to affect magnetic characteristics.

Additionally, coercive force measurements advantageously remain unaffected by sheet thickness and the thickness of any inside oxide layer on the surface of the steel sheet, as opposed to the measurement of iron loss (as a reflection of grain size).

As discussed above, coercive force can be advantageously used in the production of grain-oriented silicon steel sheet, as a control parameter for the realization of excellent and stable magnetic characteristics. By controlling the coercive force of a steel sheet subjected to primary recrystallization annealing within an optimum range (predetermined range) or an optimum value (target value), a steel product having excellent magnetic characteristics can be obtained.

The coercive force of a steel sheet subjected to primary recrystallization annealing may be increased other than through varying primary recrystallization conditions. For example, coercive force is increased when the hot-rolled sheet annealing temperature or the intermediate annealing temperature is set to a low level, or when the rolling reduction is set to a high level in cold rolling. In such cases, the coercive force is increased by the small primary recrystallized grain size. Further, a lowering of the slab heating temperature, a limited heating time a lowering of the rough-rolling temperature, and a longer hot-rolling time and the like are also factors which increase coercive force.

Factors which decrease coercive force other than primary recrystallization conditions include varying components of steel from target percentages, raising the hot-rolled sheet annealing temperature and intermediate annealing temperature, raising the cold-rolling temperature, and the like. These factors increase primary recrystallized grain size and prevent the occurrence of a finely dispersed phase with high density of an inhibitor, which decreases the inhibitor restraining force.

Although it is difficult to predict the magnitude of change of coercive force of a primary recrystallized sheet from the above-described factors, all of which occur before primary recrystallization annealing, it has been found to be possible to cause the coercive force to approach a meaningful target value by balancing inhibitor, restraining force with primary recrystallized grain size.

For example, when the inhibitor restraining force declines, it can be strengthened by using an annealing separator containing a sulfate compound, or by increasing the sulfate content thereof. When the primary recrystallized grains become large, their size can be reduced by increasing the oxygen potential during primary recrystallization annealing, by lowering the annealing temperature at the time, or by increasing the rate of temperature increase in final finish annealing.

Again, it is an advantage of the invention that the inhibit restraining force and the grain size of the primary crystals are both reflected in the coercive force, thereby ensuring that controlling the coercive force to optimal ranges will maximize magnetic characteristics. Therefore, when the coercive force is smaller than the target value, steps may be taken to increase inhibitor restraining force and/or reduce excessively large grain size. Conversely, steps may be taken to decrease inhibitor restraining force and/or increase excessively small grain size when the coercive force is larger than the target value.

A grain-oriented silicon steel sheet in accordance with the invention may be manufactured in the following manner. Molten steel obtained by a conventional steel making process is cast by a continuous casting process or an ingot making process, and formed into slabs through a blooming process when necessary. Each of the thusly obtained slabs is hot rolled to form a hot-rolled sheet, and then finished to a final thickness by cold rolling at east once, including intermediate annealings between cold rollings. Thereafter, the sheet is subjected to primary recrystallization annealing which also serves as a decarburization, and then is coated with an annealing separator during final finish annealing, the final finish annealing comprising a secondary recrystallization annealing and a purifying annealing.

suitable ranges for the components of the grain-oriented silicon steel sheet will now be described.

C content is preferably about 0.20 wt % or less because when C content exceeds about 0.20 wt %, decarburization becomes difficult.

When Si content is less than about 2.0 wt %, specific resistance is too low and a desirable iron loss level cannot be obtained, whereas when Si content exceeds about; 7.0 wt %, rolling becomes difficult. Therefore, Si content is preferably about 2.0 wt % or more and 7.0 wt % or less.

Mn content should be about 0.02 wt % or more because Mn is a component of inhibitors such as MnS, MnSe, etc., and improves hot rolling properties. However, when the content exceeds about 3.0 wt %, secondary recrystallized crystals are rendered unstable since Mn greatly affects γ transformation. Therefore, Mn content is preferably about 0.02wt % or more and about 3.0 wt % or less.

In order to obtain good secondary recrystallized crystals exhibiting excellent magnetic characteristics, it is important that the steel contain at least one element Selected from S, Se, Al , Te and B, which are known inhibitor components, in addition to the above-described components. Further, at least one element selected from Cu, Ni, Sn, Sb, As, Bi, Cr, Mo, P and N may be contained in the steel to obtain stable secondary recrystallized crystals.

Coercive force as a feature of the present invention will be described below with respect to measuring methods, and control methods. Although two measuring methods will be described, namely a method of measuring the coercive force of a steel sheet sample cut out from sheet after the sheet is subjected to primary recrystallization annealing (off-line measuring method), and a method of installing a primary coil and a secondary coil between a primary recrystallization annealing furnace and an annealing separator coating device and passing a steel striping the coils (on-line measuring method), the latter method is superior to the former method in terms of providing timely measurements usable as control parameters.

Methods of measuring the magnetizing force for the measurement of the coercive force include the application of a known coercive force; the application of a maximum flux density; magnetizing almost to saturated flux density, and the like, and any of these methods may be used in the present invention. Further, methods of changing magnetic fields include a method of substantially statically changing a magnetic field (direct current method) and a method of alternately changing a magnetic field (alternate current method), with either method being applicable to the present invention.

Further, a magnet may be used in place of a primary coil as a method of applying magnetization.

The coercive force, measured by the aforesaid methods, of a steel sheet subjected to primary recrystallization annealing is controlled so that the value is within a range determined from a previously measured coercive force from a similar primary recrystallized sheet which produced a product having excellent magnetic characteristics. Since the measured coercive force value depends upon steel composition, sheet thickness, coercive force measuring method (for example, whether the maximum flux density method or the saturated flux density method is used, the value at which flux density is set, whether the direct current method or the alternate current method is used, etc.), an absolute target range for the coercive force cannot be determined.

However, when steel sheets having substantially the same composition are produced by substantially the same manufacturing process, and the coercive forces of the sheets are measured by substantially the same method, the coercive forces of the steel sheets corresponding to excellent and stable magnetic properties will have substantially the same value. Therefore, when coercive forces of steel sheets made from a multiplicity of previously manufactured steel strip coils are measured by the same method after primary recrystallization but before secondary recrystallization starts, and the relationship between the coercive forces and magnetic characteristics has been previously determined, a target value of the coercive forces of the steel sheets can be determined.

As a means of controlling the coercive force, processing conditions which affect the coercive force may be changed at any time from the slab heating process to the cold-rolling process. However, it is preferably re to control coercive force by adjusting either the primary recrystallization annealing conditions, the components of the annealing separator and/or the secondary recrystallization annealing conditions. Further, it is more preferable to determine a coercive force target value for the primary recrystallized sheet within the predetermined optimal range, compare the target value with a measured value for the steel sheet subjected to primary recrystallization annealing, then accordingly adjust either the primary recrystallization annealing conditions, the components of the annealing separator and/or the secondary recrystallization annealing conditions. Through this process, a product having stable and excellent magnetic characteristics can be obtained.

When a measured coercive force is smaller than the target value, thereby indicating that the restraining force of the inhibitor has declined or that the primary recrystallized grain size is excessively large, at least one of the following measures may be executed to increase the measured coercive force.

1. Adjustment of primary recrystallization annealing conditions:

oxygen potential is increased during the stage of raising the temperature;

b. rate of temperature rise is increased;

c. the amount of oxygen added into the steel is reduced;

d the fayalite/silica ratio is lowered in subscale;

e. soaking temperature is decreased;

f. soaking time is shortened;

g. the amount of nitrogen is reduced or denitrizing is carried out (in the case of a grain-oriented silicon steel sheet containing Al).

2. Adjustment of annealing separator composition:

h. sulfate compounds such as $SrSO_4$, $MgSO_4$, $SnSO_4$, $Na_2SO_4$, $CaSO_4$, $FeSO_4$, $NiSO_4$, $CoSO_4$ etc. are included in the annealing separator, or their content is increased;

i. when the grain-oriented silicon steel sheet contains Al, nitrides such as FeN, $SiN_4$, $MnN_2$, TiN, CrN, etc. are included in the annealing separator, or their content is increased;

3. Adjustment of secondary recrystallization annealing conditions:

j. rate of temperature rise is increased;

k. when the grain-oriented silicon steel sheet contains Sb, the temperature for the constant temperature processing, carried out at a temperature between about 770°–950° C., is increased to create secondary recrystallized crystals or secondary recrystallized nuclei;

l. when the grain-oriented silicon steel sheet contains Al, the partial pressure of $H_2$ is lowered before secondary recrystallization starts.

on the other hand, when the measured coercive force larger than the target value, since the primary recrystallized grain size is too small or the inhibitor restraining force is excessively large, at least one measure opposite to the above measures a–l may be carried out (e.g., for a., oxygen potential is decreased by lowering the temperature, etc).

The measures a–l represent means for increasing the coercive force before the start of the secondary recrystallization. Conversely, any measure opposite to the measures a–l represent means for lowering the coercive force before the start of secondary recrystallization.

As described above, coercive force reflects both the inhibitor restraining force and the primary recrystallized grain size, both of which affect secondary recrystallization. Therefore, it is important to accurately and quantitatively adjust the measures a–l or measures opposite to a–l in accordance with deviations of the coercive force from the target value so that secondary recrystallization is properly controlled.

EXAMPLES

The invention will now be described through illustrative examples. The examples are not intended to limit the scope of the appended claims.

Example 1

Twenty-four pieces slab pieces, each containing C: 0.07 wt %, Si: 3.25 wt %, Mn: 0.07 wt % , sol Al: 0.025 wt %, S: 0.003 wt %, Se: 0.018 wt %, Sb: 0.030 wt % and N: 0.007 wt %, were heated to 1410° C. and hot rolled to 1.8 mm thick hot-rolled coils by a conventional method.

The thusly obtained coils Were annealed at 1150° C. for 50 seconds and cooled to 350° C. at a rate of 40° C./second by a mist spray, held at 350° C. for 20 seconds, and then cooled by air. Thereafter, the coils were pickled and cold-rolled by a Sendzimir mill in a temperature range of 80°–250° C. to a final sheet thickness of 0.20 mm.

The thusly obtained twenty-four cold-rolled sheets were divided into two groups of twelve.

The first twelve sheets, as comparative examples, were subjected to decarburization/primary recrystallization annealing in an atmosphere of 60% $H_2$ and 40% $N_2$ with a dew point of 55° C. under the following conditions: rate of temperature increase: 15° C./second; soaking temperature: 800° C.; and soaking time: 120 seconds. Then, 10 g/m$^2$ of annealing separator mainly composed of MgO and containing 3% $SrSO_4$ and 10% $TiO_2$ was coated on both the surfaces of the steel sheets, and the steel sheets were wound to a coil shape. Then, the coils were subjected to final finish annealing such that the temperature of the coils was raised to 840° C. at a rate of 30° C. hour in an atmosphere of $N_2$, the coils were held at the 840° C. temperature for 45 hours, then the coil temperature was raised to 1200° C. at a rate of 15° C./hour in an atmosphere of 25% $N_2$ and 75% $H_2$ and the coils were held at a temperature of 1200° C. in an atmosphere of $H_2$ for 10 hours, and then cooled.

Thereafter, annealing separator which was not reacted was removed from the coils, and the coils were subjected to a baking process which involved coating the coils with a tension coating agent in an atmosphere of $N_2$ under a temperature of 800° C. and at a holding time of 90 seconds. This baking process also served as a flattening annealing.

The other twelve sheets, as examples produced in accordance with the invention, were subjected to the same decarburization/primary recrystallization annealing as that applied to the comparative examples. Then, samples were cut from the coils, and the coercive force for each sample was measured, and a coercive force target value which optimized magnetic characteristics for the coils was determined in a laboratory. A coercive force target value 139A/m was thusly obtained.

Thereafter, the $SrSO_4$ content of the annealing separator forth first three coils was adjusted; the holding temperature at which the next three coils were held for 45 hours in the final finish annealing was adjusted; the partial pressure of $H_2$ in the mixed atmosphere of $N_2$+$H_2$ of the next three coils was adjusted when the coil temperature was increased from 840° C. to 1200° C.; and the rate of temperature increase from 840° C. to 1200° C. of the remaining three coils was adjusted; all adjustment performed so as to eliminate the difference between the target coercive force and the coercive forces. of the respective coils. The coils were then subjected to final finish annealing substantially similar to that of the comparative examples (except for the above-described conditions).

Thereafter, unreacted annealing separator on the coils was removed like in the comparative examples. The coils were then subjected to a baking process which involved coating the coils with a tension coating agent in an atmosphere of $N_2$ at a temperature of 800° C. and a holding time of 90 seconds, like in the comparative examples, This baking process likewise served as a flattening annealing.

The secondary recrystallization temperature of the steel sheets subjected to the primary recrystallization annealing was 1100° C.

Tables 1 and 2 show product magnetic characteristics (flux density, iron loss) of the comparative examples and examples produced in accordance with the invention, respectively.

Thereafter, the sheets were degreased and then subjected to decarburization/primary recrystallization annealing.

The first sixteen sheets, as comparative examples, were subjected to decarburization/primary recrystallization annealing in an atmosphere of 50% $H_2$ and 50% $N_2$ with a dew point of 50° C. under the following conditions: rate of temperature increase: 10° C./second; soaking temperature: 835° C.; and soaking time: 120 seconds. Then, 8 g/m$^2$ of an annealing separator mainly composed of MgO and containing 1% $MgSO_4$, 2% $TiO_2$, and 1% $SrSO_4$ was coated on both the surfaces of the steel sheets. Each steel sheet was then wound to a coil shape.

Coercive forces of the sheets were continuously measured by an outline system just before the coils were coated with the annealing separator but after they were subjected to primary recrystallization annealing.

Thereafter, the coils were subjected to final finish annealing such that the temperature of the coils was raised to 850° C. at a rate of 40° C./hour in an atmosphere of $N_2$; and the coils were held at the 850° C. temperature for 50 hours, then the temperature of the coils was raised to 1200° C. at a rate of 30° C./hour in an atmosphere of 35% $N_2$ and 65% $H_2$. The coils were held at 1200° C. in an atmosphere of $H_2$ for 5 hours, and then cooled.

TABLE 1

Comparative Examples

| Coil Passing No. | 1 | 2 | 3 | 4 | 5 | 6 | 7 | 8 | 9 | 10 | 11 | 12 | Maximum Value | Minimum Value | Average Value |
|---|---|---|---|---|---|---|---|---|---|---|---|---|---|---|---|
| $B_8$(T) | 1.928 | 1.938 | 1.944 | 1.921 | 1.925 | 1.942 | 1.924 | 1.933 | 1.926 | 1.920 | 1.933 | 1.930 | 1.944 | 1.920 | 1.930 |
| $W_{17/50}$ (W/kg) | 0.75 | 0.70 | 0.67 | 0.77 | 0.75 | 0.68 | 0.75 | 0.74 | 0.76 | 0.78 | 0.73 | 0.74 | 0.78 | 0.67 | 0.73 |

TABLE 2

Examples Produced in Accordance with the Invention

| Coil Passing No. | 1 | 2 | 3 | 4 | 5 | 6 | 7 | 8 | 9 | 10 | 11 | 12 | Maximum Value | Minimum Value | Average Value |
|---|---|---|---|---|---|---|---|---|---|---|---|---|---|---|---|
| $B_8$(T) | 1.942 | 1.943 | 1.943 | 1.946 | 1.945 | 1.943 | 1.944 | 1.943 | 1.943 | 1.944 | 1.945 | 1.943 | 1.946 | 1.943 | 1.943 |
| $W_{17/50}$ (W/kg) | 0.68 | 0.68 | 0.67 | 0.67 | 0.67 | 0.68 | 0.68 | 0.68 | 0.68 | 0.68 | 0.67 | 0.68 | 0.68 | 0.67 | 0.677 |
| Condition changed from comparative examples in Table 1 | Additive amount of $SrSO_4$ | | | Holding Temperature | | | $H_2$ Partial Pressure | | | Temperature Increasing Speed | | | | | |

As shown in Tables 1 and 2, the examples produced in accordance with the invention have superior magnetic characteristics to the comparative examples, and exhibit stable magnetic values with very small deviation between the coils.

Example 2

Eight steel slab pieces each containing C: 0.04 wt %, Si: 2.95 wt %, Mn: 0.07 wt %, P: 0.05 wt %, S: 0.003 wt %, Se: 0.02 wt %, Sb: 0.02 wt % and Mo: 0.01 wt % were heated to 1350° C. for 50 minutes and then formed into 2.4 mm thick hot-rolled coils through conventional hot rolling.

Each of the thusly obtained hot-rolled coils was divided into four portions to make thirty-two coils in total. Then, each coil was pickled and cold rolled to a thickness of 0.75 mm, then subjected to intermediate annealing at a temperature of 950° C. for 60 seconds, and further cold rolled to steel sheets having a final thickness of 0.30 mm.

Thereafter, annealing separator which was not reacted was removed from the coils, then each coil was subjected to a baking process which involved being coated with a tension coating agent in an atmosphere of $N_2$ at a temperature of 800° C. and a holding time of 90 seconds. This baking process also served as a flattening annealing.

The magnetic characteristics of the thusly obtained products were measured and are shown in Table 3.

TABLE 3

| Comparative Examples | | | | | | | | | |
|---|---|---|---|---|---|---|---|---|---|
| Coil Passing No. | 1 | 2 | 3 | 4 | 5 | 6 | 7 | 8 | |
| $B_8$(T) | 1.895 | 1.903 | 1.884 | 1.898 | 1.902 | 1.889 | 1.896 | 1.882 | |
| $W_{17/50}$ (w/kg) | 1.073 | 1.032 | 1.103 | 1.053 | 1.044 | 1.093 | 1.063 | 1.112 | |
| Coil Passing No. | 9 | 10 | 11 | 12 | 13 | 14 | 15 | 16 | 1–16 Average value |
| $B_8$(T) | 1.890 | 1.888 | 1.900 | 1.893 | 1.874 | 1.895 | 1.897 | 1.904 | 1.8931 |
| $W_{17/50}$ (w/kg) | 1.085 | 1.098 | 1.050 | 1.083 | 1.143 | 1.076 | 1.055 | 1.013 | 1.0735 |

TABLE 4

| Examples Produced in Accordance with the Invention | | | | | | | | | |
|---|---|---|---|---|---|---|---|---|---|
| Coil Passing No. | 17 | 18 | 19 | 20 | 17–20 Average value | 21 | 22 | 23 | 21–23 Average value |
| $B_8$(T) | 1.903 | 1.904 | 1.904 | 1.903 | 1.9035 | 1.904 | 1.904 | 1.903 | 1.9037 |
| $W_{17/50}$ (w/kg) | 1.031 | 1.023 | 1.025 | 1.033 | 1.0280 | 1.015 | 1.028 | 1.035 | 1.0260 |
| Coil Passing No. | 24 | 25 | 26 | 24–26 Average value | 27 | 28 | 29 | 27–29 Average value | |
| $B_8$(T) | 1.903 | 1.904 | 1.904 | 1.9037 | 1.904 | 1.903 | 1.904 | 1.9037 | |
| $W_{17/50}$ (w/kg) | 1.036 | 1.023 | 1.016 | 1.0230 | 1.025 | 1.034 | 1.018 | 1.0257 | |
| Coil Passing No. | 30 | 31 | 32 | 30–32 Average value | 17–32 Average value | | | | |
| $B_8$(T) | 1.904 | 1.904 | 1.903 | 1.9037 | 1.9036 | | | | |
| $W_{17/50}$ (w/kg) | 1.016 | 1.020 | 1.028 | 1.0213 | 1.0254 | | | | |

In Table 3, comparative example 16 exhibited the best magnetic characteristics, thus its coercive force was used as a target value for the other sixteen coils (coils, 17–32 in Table 4). Then, in accordance with the invention, decarburization/primary recrystallization annealing conditions of the remaining sixteen coils were changed so that their respective coercive forces corresponded with the target value when measured by an on-line system just before the coils were coated with the annealing separator.

The sixteen remaining coils were then subjected to decarburization/primary recrystallization annealing. The decarburization/primary recrystallization annealing conditions were adjusted such that the oxygen potential was charged in the coils 17–20 when their temperature was increased, the rate of temperature increase was adjusted for coils 21–23, the line speed was adjusted for coils 24–26, the soaking temperature was adjusted for oils 27–29, and the oxygen potential was adjusted in the soaking operation for coils 30–32, so that the coercive forces of the respective coils 17–32 coincided with the target value.

When the line speed was adjusted for coils 24–26, the rate of temperature increase and the soaking speed were adjusted at the same time. When the oxygen potential was adjusted in the soaking operation for coils 30–32, the fayalite/silica ratio of subscale and the amount of oxygen added into the steel were adjusted at the same time.

Further, when the coercive force at the leading end portion of each of the respective coils did not coincide with the target value, the $MgSO_4$ content of the annealing separator used on the leading end portion was adjusted in accordance with the deviation of the coercive force from the target value so that excellent magnetic characteristics were obtained. Thereafter, the coils were coated with the annealing separator under conditions similar to those of the comparative examples, wound to a coil shape, and then subjected to final finish annealing. Next, after unreacted annealing separator was removed from the coils, the coils were subjected to a baking process which involved being coated with a tension coating agent. This baking process also served as a flattening annealing.

Table 4 shows the magnetic characteristics of resulting product coils 17–32 produced in accordance with the invention.

As apparent from Tables 3 and 4, the examples produced in accordance with the invention exhibit magnetic characteristic values which are similar to values exhibited by the best of the comparative examples. Further, there is only a very small deviation between magnetic characteristic values within examples 17–32 produced in accordance with the invention.

Example 3

Sixty pieces of steel slab were taken from each of four steels A–D containing components at target quantities as shown in Table 5 were hot rolled to 2.2 mm thick hot-rolled sheets according to a conventional method after the steels A and B were heated to a temperature of 1400° C. and the steels C and D were heated temperature of 1300° C.

TABLE 5

| Type of Steel | | C | Si | Mn | P | S | Al | Cu | Sn | Sb | Se | N |
|---|---|---|---|---|---|---|---|---|---|---|---|---|
| A | Target value | 0.06 | 3.35 | 0.07 | 0.015 | 0.015 | 0.027 | 0.15 | 0.17 | trace | trace | 0.007 |
| | Deviation | ±0.003 | ±0.01 | ±0.003 | ±0.002 | ±0.003 | ±0.002 | ±0.01 | ±0.01 | | | ±0.0005 |
| B | Target value | 0.07 | 3.25 | 0.07 | 0.008 | 0.003 | 0.022 | 0.02 | 0.02 | 0.045 | 0.018 | 0.007 |
| | Deviation | ±0.003 | ±0.01 | ±0.003 | ±0.003 | ±0.002 | ±0.002 | ±0.005 | ±0.005 | ±0.002 | ±0.001 | ±0.0005 |
| C | Target value | 0.03 | 3.00 | 0.15 | 0.008 | 0.005 | 0.025 | 0.02 | 0.02 | trace | trace | 0.005 |
| | Deviation | ±0.002 | ±0.01 | ±0.005 | ±0.003 | ±0.003 | ±0.002 | ±0.005 | ±0.005 | | | ±0.0004 |
| D | Target value | 0.02 | 2.50 | 1.70 | 0.008 | 0.005 | 0.013 | 0.02 | 0.02 | trace | trace | 0.005 |
| | Deviation | ±0.002 | ±0.01 | ±0.007 | ±0.004 | ±0.003 | ±0.002 | ±0.005 | ±0.005 | | | ±0.0004 |

The coils were rapidly cooled in mist water after they were hot-rolled at a temperature of 1150° C. and then cold-rolled in a temperature range of 120°–300° C. to 0.30 mm thick cold-rolled sheets.

Thereafter, thirty coil pieces from each of the steels A–D, as comparative examples, were subjected to decarburization/primary recrystallization annealing in an atmosphere of 50% $H_2$ and 50% $N_2$ with a dew point of 60° C. at a temperature of 850° C. for 120 seconds. Then, 13 g/m$^2$of an annealing separator mainly composed of MgO and containing 5% $TiO_2$ was coated on both the surfaces of the steel sheets, and the steel sheets were wound to a coil shape.

Thereafter, the coils were heated to a temperature of 850° C. at a rate of 30° C./hour in an atmosphere of $N_2$. Then, the coils were subjected to final finish annealing in an atmosphere of 25% $N_2$ and 75% $H_2$ such that the coils of steels A, B and C were heated in a temperature region from 850° C. to 1200° C. at a rate of 15° C./hour, while the coils of steel D were heated in a temperature region from 850° C. to 1000° C. at a rate of 15° C./hour. Subsequently, the coils of steels A, B and C were held at a temperature of 1200° C. for 5 hours, and the coils of steel D were held at a temperature of 1000° C. for 5 hours.

Then, after unreacted annealing separator was removed from the coils, the coils were subjected to a baking process which included being coated with a tension coating agent in an atmosphere of $N_2$ at a temperature of 800° C. for 90 seconds. This process also served as flattening annealing.

The remaining thirty coils of each of steels A–D were prepared in accordance with the invention. An optimum coercive force of sheet samples of each steel type having been subjected to decarburization/primary recrystallization annealing was determined in a laboratory, and the value of the optimum coercive force for each steel type was set as a target coercive force. The coercive forces of the coils were measured by an on-line coercive force measuring instrument installed at a position before the coils were coated with an annealing separator but after they were subjected to the decarburization/primary recrystallization annealing. Then, process conditions were optimized by carrying out at least one or a combination of two or more of the following processes to eliminate deviations of the measured coercive forces from the target coercive force:

adjusting the decarburization/primary recrystallization annealing conditions;

adjusting the composition of the annealing separator; and/or adjusting the final finish annealing conditions.

The magnitude of the adjustment(s) to the annealing conditions was determined in accordance with the deviation from the target coercive force. The adjustments to the composition of the annealing separator comprised changing the content of $SrSO_4$ in steel B, and changing the content of $Fe_xN$ in steels A, C and D.

After final finish annealing and the removal of unreacted annealing Separator from the coils, the coils were subjected to a baking process which involved being coated with a tension coating agent in an atmosphere of $N_2$at a temperature of 800° C. for 90 seconds. This processing also served as a flattening annealing.

Table 6 shows average values of magnetic characteristics measured for the examples produced in accordance with the invention and the comparative examples.

TABLE 6

| Type of Steel | Magnetic Characteristics | Comparative Examples | Examples Produced in Accordance with the Invention |
|---|---|---|---|
| A | $B_8$ (T) | 1.923 | 1.935 |
| | $W_{17/50}$ (W/kg) | 1.095 | 1.043 |
| B | $B_8$ (T) | 1.932 | 1.957 |
| | $W_{17/50}$ (W/kg) | 1.074 | 0.984 |
| C | $B_8$ (T) | 1.860 | 1.883 |
| | $W_{17/50}$ (W/kg) | 1.173 | 1.096 |
| D | $B_8$ (T) | 1.823 | 1.865 |
| | $W_{17/50}$ (W/kg) | 1.263 | 1.154 |

revealed in Table 6, the magnetic characteristics of the examples produced in accordance with the invention are vastly superior to those of the comparative examples.

According to the present invention, a new method for producing a high yield of grain-oriented silicon steel sheet having stable and excellent electromagnetic characteristics is provided. Steel sheets obtained by the method of the present invention are consistent in quality and can be very advantageously utilized as a transformer bore material or the like.

Although this invention has been described with reference to specific forms of apparatus and method steps, equivalent steps may be substituted, the sequence of the steps may be varied, and certain steps may be used independently of others. Further, various other control steps may be included, all without departing from the spirit and scope of the invention defined in the appended claims.

What is claimed is:

1. A method of manufacturing a grain-oriented silicon steel sheet having excellent magnetic characteristics comprising the steps of:

(a) forming a silicon steel slab;

(b) hot rolling said silicon steel slab to form a hot-rolled sheet;

(c) cold rolling said hot-rolled sheet at least once to form a cold-rolled sheet, said cold rolling including an intermediate annealing between cold rollings;

(d) primary recrystallization annealing said cold-rolled sheet to form a primary recrystallized sheet having a coercive force;

(e) final finish annealing said primary recrystallized sheet to form said grain-oriented silicon steel sheet, said final finish annealing including a secondary recrystallization annealing and a purifying annealing, wherein said primary recrystallized sheet is coated with an annealing separation agent and is caused to undergo secondary recrystallization during said final finish annealing, and (f) controlling said coercive force of said primary recrystallized sheet prior to said secondary recrystallization.

2. The method according to claim 1, wherein said step (f) of controlling of said coercive force comprises the steps of:

measuring said coercive force of said primary recrystallized sheet to determine a coercive force value; and executing at least one adjustment to said steps (a)–(e), based upon said coercive force value, said adjustment being selected from the group consisting of adjusting said primary recrystallization annealing, adjusting the composition of said annealing separator, and adjusting said secondary recrystallization annealing.

3. The method according to claim 2, wherein said measuring of said coercive force is performed using an on-line system.

* * * * *

UNITED STATES PATENT AND TRADEMARK OFFICE

CERTIFICATE OF CORRECTION

PATENT NO. : 5,665,178

DATED : September 9, 1997

INVENTOR(S) : Michiro Komatsubara, Masayoshi Ishida and Bunihiro Senda

It is certified that error appears in the above-indentified patent and that said Letters Patent is hereby corrected as shown below:

In Column 4, line 37, please change "Of" to --of--.

In Column 11, Table 4, row 3, line 2, column 5, please change "1.0230" to --1.0250--;
Table 4, row 3, line 4, column 3, please delete "30";
Table 4, row 3, line 4, column 4, please delete "31"; and
Table 4, row 3, line 4, column 5, please delete "32".

In Column 14, line 47, please change "revealed" to --As revealed--.

Signed and Sealed this

Thirtieth Day of December, 1997

Bruce Lehman

*Attest:*

BRUCE LEHMAN

*Attesting Officer*

*Commissioner of Patents and Trademarks*